US011103042B1

(12) United States Patent
Smith

(10) Patent No.: US 11,103,042 B1
(45) Date of Patent: Aug. 31, 2021

(54) PORTABLE PEDICURE/MANICURE ASSIST KIT

(71) Applicant: Lucus Smith, Savage, MN (US)

(72) Inventor: Lucus Smith, Savage, MN (US)

( * ) Notice: Subject to any disclaimer, the term of this patent is extended or adjusted under 35 U.S.C. 154(b) by 799 days.

(21) Appl. No.: 15/721,758

(22) Filed: Sep. 30, 2017

(51) Int. Cl.
*A45D 29/20* (2006.01)
*A45C 11/00* (2006.01)

(52) U.S. Cl.
CPC ..... *A45D 29/20* (2013.01); *A45C 11/008* (2013.01)

(58) Field of Classification Search
CPC ..... A45C 2200/15; A47C 7/705; A47C 7/68; A45D 29/22; A45D 29/20; A45D 29/00
USPC ..... 108/42, 47; 248/231.61, 230.5, 228.5, 248/229.14, 229.24, 118.5, 118.3, 118.1, 248/118; 132/73.5
See application file for complete search history.

(56) References Cited

U.S. PATENT DOCUMENTS 881,727 A * 3/1908 Shurtz ..... B23Q 3/00 108/143
1,374,907 A * 4/1921 Cofrode ..... B60N 2/783 296/153
1,621,789 A * 3/1927 Kent ..... A47C 7/68 132/73.5
1,674,205 A * 6/1928 Johnson ..... B60N 2/783 296/153
1,742,447 A * 1/1930 McKeag ..... B60N 2/783 296/153
1,873,190 A * 8/1932 Doller ..... B60N 2/783 296/153
1,873,414 A * 8/1932 Jarvis ..... B60N 2/783 297/411.22
2,426,097 A * 8/1947 Heller ..... A47C 7/70 297/135
2,477,898 A * 8/1949 Rehman ..... A45D 29/22 248/118
2,986,437 A * 5/1961 Davis ..... A47C 16/02 108/157.13
4,294,268 A 10/1981 Kitrell
4,576,351 A * 3/1986 Brink ..... A61G 5/125 248/118
4,949,407 A * 8/1990 Singer ..... A45D 44/10 4/519
5,022,622 A * 6/1991 Schaevitz ..... A47B 21/0371 182/230
5,184,795 A 2/1993 Sexton
(Continued)

FOREIGN PATENT DOCUMENTS

DE 202005008660 * 11/2005
GB 2513684 A 11/2014
(Continued)

OTHER PUBLICATIONS

Stedi Pedi system, Available Online at http://stedipedi.com/, Available Apr. 27, 2017, Retrieved Apr. 30, 2019, 7 pages.

*Primary Examiner* — Yogesh P Patel
*Assistant Examiner* — Jennifer Gill
(74) *Attorney, Agent, or Firm* — Krenz Patent Law, LLC

(57) ABSTRACT

A portable pedicure/manicure assist kit for providing a quick and effective way to do one's pedicure and manicure. The portable pedicure/manicure assist kit includes a support assembly including a foot/hand rest member and at least one support member connected to the foot/hand rest member.

20 Claims, 4 Drawing Sheets

(56) References Cited

U.S. PATENT DOCUMENTS

| | | | | |
|---|---|---|---|---|
| 5,385,322 | A * | 1/1995 | Kim | A47B 21/0371 248/118 |
| 5,639,143 | A | 6/1997 | Ackerman | |
| 5,927,663 | A * | 7/1999 | Tseng | A47B 21/0371 248/118.5 |
| 6,115,857 | A * | 9/2000 | Bidegain | A47K 3/281 4/571.1 |
| 6,116,249 | A * | 9/2000 | Tuffery | A45D 29/05 132/200 |
| 6,532,969 | B2 | 3/2003 | Nuzzo | |
| D487,533 | S | 3/2004 | Abbott et al. | |
| 7,066,547 | B1 | 6/2006 | Russell et al. | |
| 7,648,108 | B2 | 1/2010 | Peterson | |
| 8,814,152 | B2 * | 8/2014 | Guenther | B23Q 3/00 269/71 |
| 2012/0023790 | A1 * | 2/2012 | Yang | D06F 75/40 38/79 |
| 2016/0015146 | A1 * | 1/2016 | Accarrino | A45D 24/02 224/267 |
| 2017/0086559 | A1 | 3/2017 | Mulroy | |

FOREIGN PATENT DOCUMENTS

| | | | |
|---|---|---|---|
| KR | 1297499 | * | 8/2013 |
| WO | WO 99/06627 | * | 7/1998 |

* cited by examiner

PORTABLE PEDICURE/MANICURE ASSIST KIT

BACKGROUND OF THE INVENTION

Field of the Invention

The present invention relates to pedicure/manicure kits and more particularly pertains to a new portable pedicure/manicure assist kit for providing a quick and effective way to do one's pedicure and manicure.

Description of the Prior Art

The use of pedicure/manicure kits is known in the prior art. More specifically, pedicure/manicure kits heretofore devised and utilized are known to consist basically of familiar, expected and obvious structural configurations, notwithstanding the myriad of designs encompassed by the crowded prior art which have been developed for the fulfillment of countless objectives and requirements.

The prior art includes an adjustable foot support and at least one product storage compartment. Another prior art includes a support having a base and a top with a convex foot pad extending from the top to the front side. One or more receptacles for grooming articles are provided. The base has a hanger which facilitates storage of the foot support on the edge of a bath tub. Also, another prior art includes a first inverted U-shaped member which is adapted to be placed on a bathroom floor and extended upwardly therefrom. A second U-shaped supporting member is pivotally secured adjacent its forward end to the upper end of the first supporting member and is adapted to have its rearward end extended over the forward lip of a toilet bowl. A supporting foot plate is pivotally secured adjacent its rearward end to the second support member forwardly of the rearward end thereof and has its lower forward end detachably secured to the upper end of the first supporting, member. While these devices fulfill their respective, particular objectives and requirements, the aforementioned patents do not disclose a new portable pedicure/manicure assist kit.

SUMMARY OF THE INVENTION

The general purpose of the present invention, which will be described subsequently in greater detail, is to provide a new portable pedicure/manicure assist kit which has many of the advantages of the pedicure/manicure kits mentioned heretofore and many novel features that result in a new portable pedicure/manicure assist kit which is not anticipated, rendered obvious, suggested, or even implied by any of the prior art pedicure/manicure kits, either alone or in any combination thereof. The present invention includes a support assembly including a foot/hand rest member and at least one support member connected to the foot/hand rest member. None of the prior art includes the combination of the elements of the present invention.

There has thus been outlined, rather broadly, the more important features of the portable pedicure/manicure assist kit in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new portable pedicure/manicure assist kit which has many of the advantages of the pedicure/manicure kits mentioned heretofore and many novel features that result in a new portable pedicure/manicure assist kit which is not anticipated, rendered obvious, suggested, or even implied by any of the prior art pedicure/manicure kits, either alone or in any combination thereof.

Still another object of the present invention is to provide a new portable pedicure/manicure assist kit for providing a quick and effective way to do one's pedicure and manicure.

Still yet another object of the present invention is to provide a new portable pedicure/manicure assist kit that can be quickly and conveniently attached to and detached from waste baskets, pails or any other types of supports.

Even still another object of the present invention is to provide a new portable pedicure/manicure assist kit that effectively catches clippings and provides comfort for the user doing one's feet and hands.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
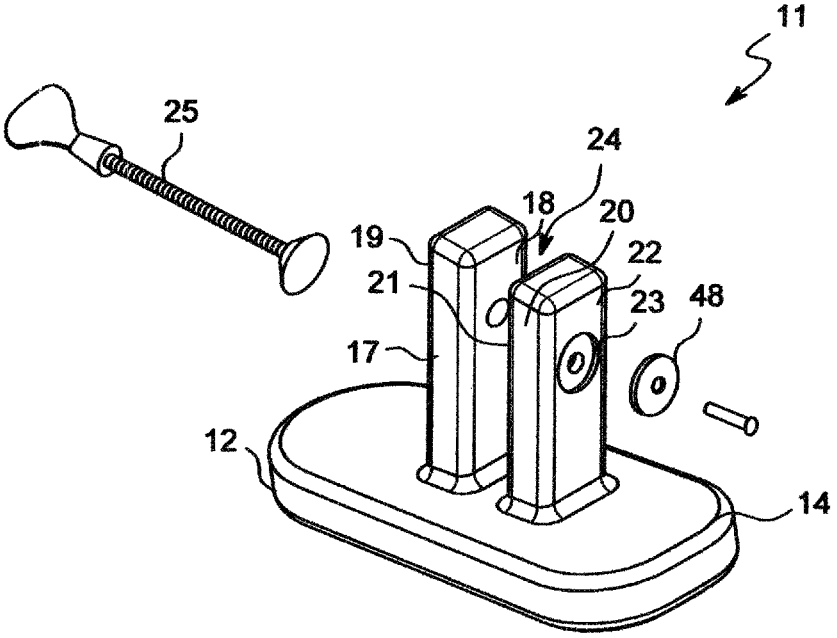
FIG. 1 is an exploded bottom, front perspective view of a support assembly of a new portable pedicure/manicure assist kit according to the present invention.
Figure 2:
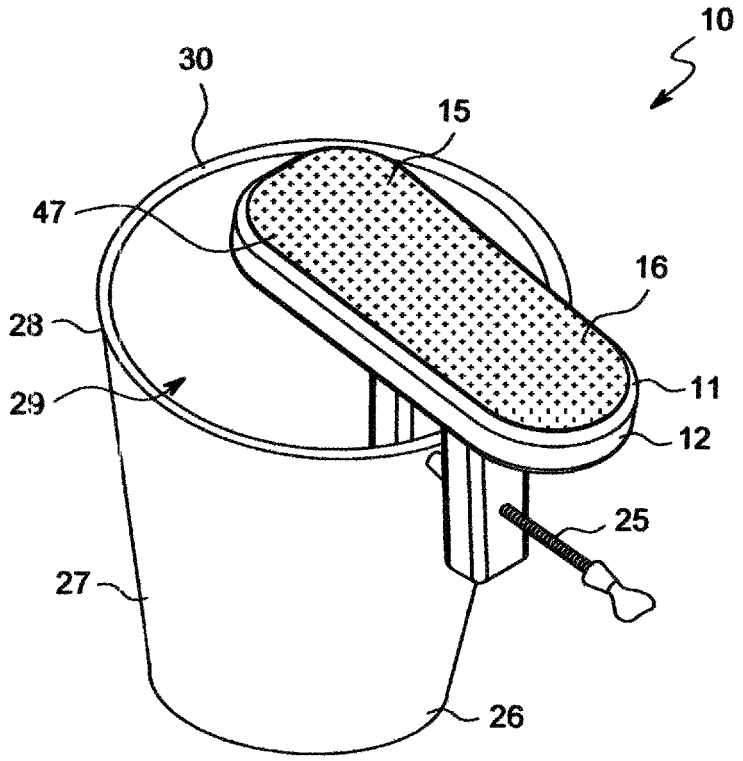
FIG. 2 is a top perspective view of the support assembly clamped to a container of the present invention.
Figure 3:
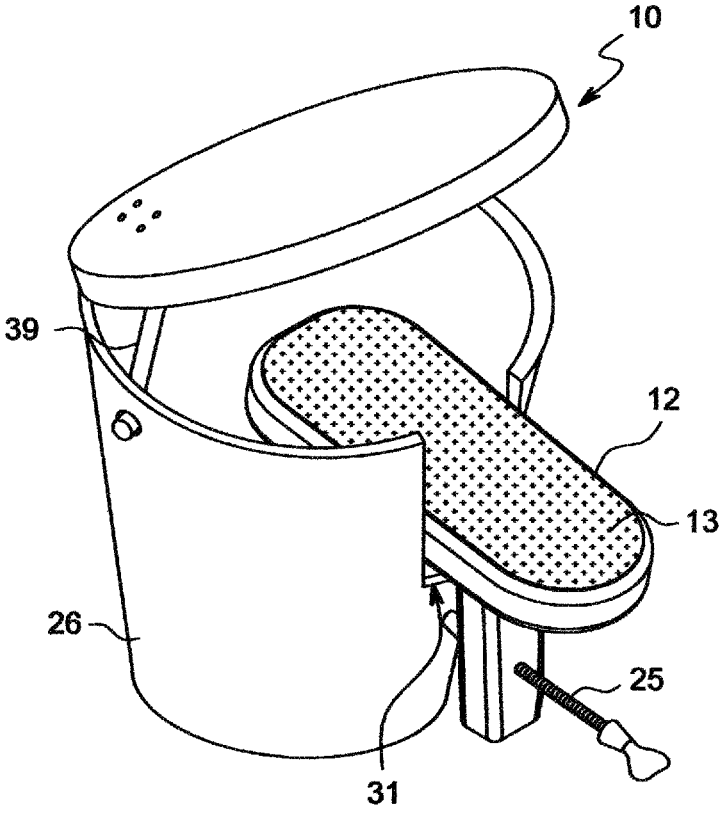
FIG. 3 is a top perspective view of the support assembly mounted in a slot of the container of the present invention.
Figure 4:
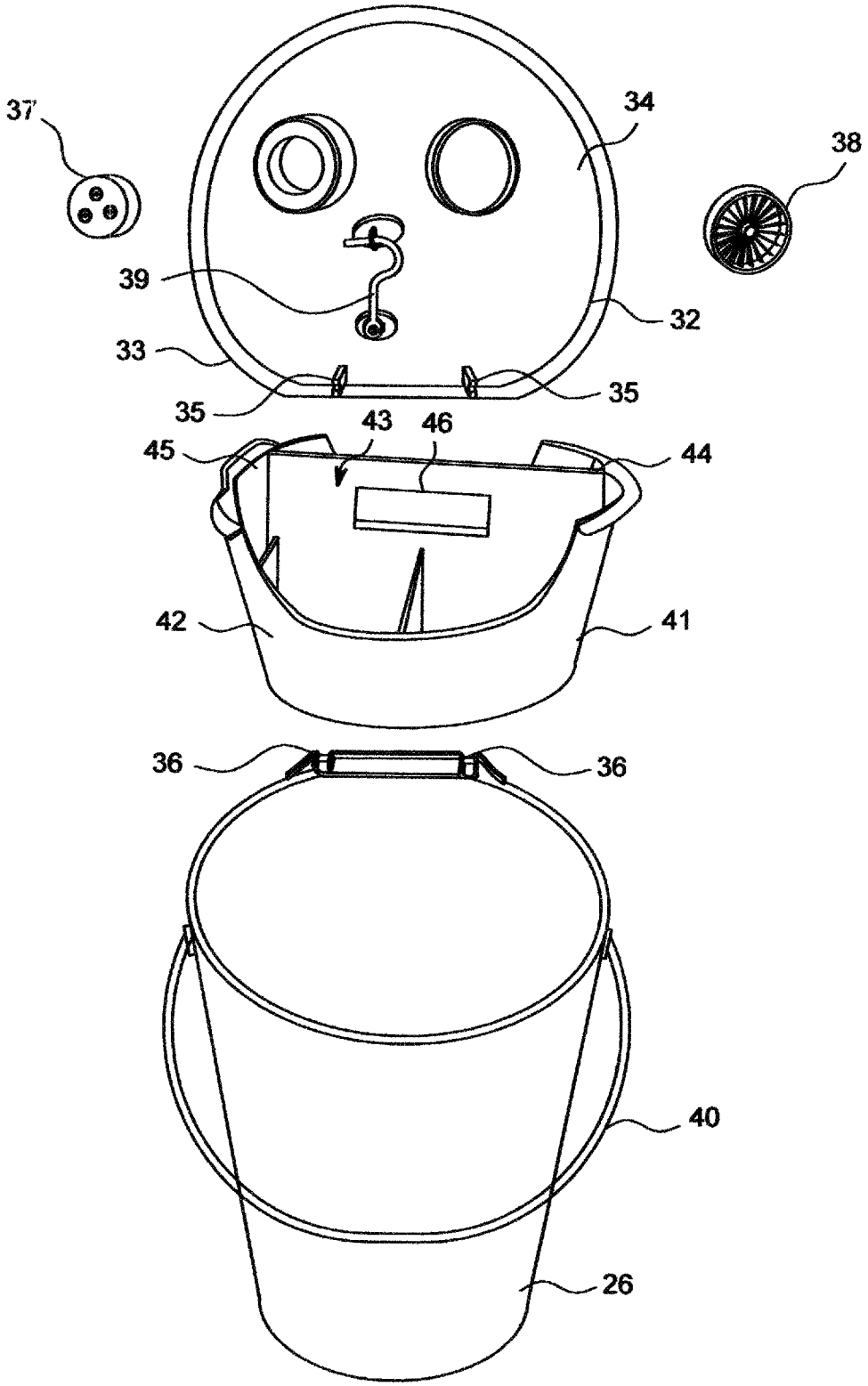
FIG. 4 is an exploded perspective view of the container and a try of the present invention.

With reference now to the drawings, and in particular to FIGS. 1 through 4 thereof, a new portable pedicure/manicure assist kit embodying the principles and concepts of the present invention and generally designated by the reference numeral 10 will be described.

As best illustrated in FIGS. 1 through 4, the portable pedicure/manicure assist kit 10 generally comprises a support assembly 11 including a foot/hand rest member 12, and at least one support member 17, 20 conventionally connected to the foot/hand rest member 12. The foot/hand rest member 12 is planar and has a top side 13 and a bottom side 14 with an anti-slip padded member 47 disposed upon the top side 13. The foot/hand rest member 12 has a back portion 16 and an enlarged front portion 15 upon which a user's hand or foot rests when being used.

The at least one support member 17, 20 is conventionally attached to and intermediate of the bottom side 14 of the foot/hand rest member 12. The at least one support member 17, 20 includes a first support member 17 and a second support member 20 extending outwardly from the bottom side 14 of the foot/hand rest member 12. The first and second support members 17, 20 are spaced apart and form a slot 24 therebetween. The first support member 17 has a planar side 18 facing the second support member 20 and the second support member 20 has a first planar side 21 facing the first support member 17 and disposed parallel to the planar side 18 of the first support member 17. The first support member 17 has a distal end 19 spaced from the bottom side 14 of the foot/hand rest member 12. The first and second support members 17, 20 are angled relative to the bottom side 14 and towards the back portion 16 of the foot/hand rest member 12. The second support member 20 has a second side 22 facing away from the first support member 17 with a recess 23 disposed in the second side 22 and with a magnet 48 conventionally disposed and engaged in the recess 23 to support, store and make readily available nail clippers. The support assembly 11 also includes a screw 25 threaded through the first support member 17 proximate to the distal end 19 and forming a clamp in cooperation with the second support member 20.

The portable pedicure/manicure assist kit 10 further includes a container 26 having a side wall 27, a handle 40 conventionally attached to the side wall 27, an open top 30, a cavity 29 disposed therein, and also includes a lid 32 removably and hinged to the container 26 and has an underside 34. The lid 32 is positionably ajarred above the open top 30 of the container 26 to prevent nail clippings from being splattered about when performing a pedicure/manicure procedure. The support assembly 11 is mounted to the container 26 with the front portion 15 of the foot/hand rest member 12 disposed in the cavity 29. The support assembly 11 is removably mounted to the side wall 27 of the container 26 with a portion of the side wall 27 disposed in the slot 24 between the first and second support members 17, 20. The container 26 has a slot 31 disposed through a top edge 28 of the side wall 27 and downwardly in the side wall 27. The support assembly 11 is clamped to the side wall 27 in the slot 31 of the container 26 with a portion of the side wall 27 below the slot 31 received between the first and second support members 17, 20 and engaged between the screw 25 and the second support member 20. The lid 32 has an outer edge 33 with clips 35 spaced apart and integrally extending from the outer edge 33, and the container 26 has catches 36 spaced apart and integrally disposed along the top edge 28 of the side wall 27. The lid 32 is removable from the container 26 with the clips 35 being detachably attached to the catches 36.

The portable pedicure/manicure assist kit 10 further includes a battery-operated light-emitting member 37, and a battery-operated fan 38 conventionally detachably attached to the underside 34 of the lid 32, and also includes a lid support member 39 conventionally and pivotably attached to the underside 34 of the lid 32 for securing the lid 32 in a partially opened and ajarred position above the open top 30 of the container 26. The portable pedicure/manicure assist kit 10 also includes a tray 41 removably disposed in the cavity 29 of the container 26 and having a perimeter wall 42, a cavity 43 and a partition 44 conventionally disposed in the cavity 43 of the tray 41 and forming compartments to store items related to pedicures and manicures. The tray 41 also has a handle 46 integrally attached to and along a top edge 45 of the partition 44.

In use, the support assembly 11 which may be an integral part of the container 26 or may be detachably mounted to the container 26 is disposed such that the front portion 15 of the foot/hand rest member 12 is disposed in the cavity 29 of the container 26 and is slanted upwardly from the back portion 16 to the front portion 15 so that the foot or hand is slanted upwardly to facilitate doing either a pedicure or a manicure procedure including cutting the toe or finger nails. The lid 32 on the containers 26 is ajarred slightly above the open top 30 of the container 26 so that the nail clipping will bounce off the underside 34 of the lid 32 and into the container 26 rather than splatter outside the container 26. The user may turn on the light emitting member 37 to assist in the procedure and if the procedure includes painting the nails, the fan 38 may be energized to dry the paint. Once finished the support assembly 11 if detachable can be removed by unscrewing the screw 25 and removing the support assembly 11 from the container 26.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the portable pedicure/manicure assist kit. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable pedicure/manicure assist device, consisting of:

a support assembly including a foot/hand rest member, a first support member and a second support member, and only a single magnet, wherein the foot/hand rest member includes a top surface and a bottom surface, wherein the first support member and the second support member are fixed to the bottom surface of the foot/hand rest member, and wherein a first end of the first support member and a first end of the second support member are each in direct physical contact with the bottom surface of the foot/hand rest member;

wherein the first support member and the second support member extend from the bottom surface of the foot/hand rest member, wherein the first support member and the second support member are about a same length and parallel to each other along an entire greatest length of at least one of the first support member and the second support member, forming a slot therebetween, and wherein the slot has a width that is less than one-half a greatest length of the foot/hand rest member;

wherein the support assembly further includes a screw threaded through the first support member, the screw forming a clamp in cooperation with the second support member; and wherein the single magnet is disposed on an outward-facing surface of the second support member.

2. A portable pedicure/manicure assist kit including the device of claim 1 and a container having a side wall and defining a cavity within the container.

3. The portable pedicure/manicure assist device as described in claim 1, wherein the top surface of the foot/hand rest member is planar, and wherein an anti-slip padded member is disposed on the top surface.

4. The portable pedicure/manicure assist device as described in claim 1, wherein the foot/hand rest member includes a forward end and a rearward end, and wherein a width of the forward end is larger than a width of the rearward end.

5. The portable pedicure/manicure assist device as described in claim 1, wherein the screw is threaded through the first support member proximate to a distal end of the first support member.

6. The portable pedicure/manicure assist device as described in claim 1, wherein the top surface of the foot/hand rest member is imperforate.

7. The portable pedicure/manicure assist device as described in claim 1, wherein corners of the foot/hand rest member are rounded.

8. The portable pedicure/manicure assist device as described in claim 1, wherein the magnet has a disc shape.

9. A portable pedicure/manicure assist device, consisting of:

a support assembly including a foot/hand rest member, a first support member and a second support member, and a magnet, wherein the foot/hand rest member includes a top surface and a bottom surface, wherein the first support member and the second support member are about a same length and fixed to the bottom surface of the foot/hand rest member, and wherein a first end of the first support member and a first end of the second support member are each in direct physical contact with the bottom surface of the foot/hand rest member;

wherein the first support member and the second support member extend substantially vertically from the bottom surface of the foot/hand rest member, wherein the first support member and the second support member are a same length and parallel to each other along an entire greatest length of at least one of the first support member and the second support member, forming a slot therebetween, and wherein the slot has a width that is less than one-half a greatest length of the foot/hand rest member;

wherein the support assembly further includes a screw threaded through the first support member, the screw forming a clamp in cooperation with the second support member; and wherein the magnet is disposed on only one of the first support member or the second support member.

10. The portable pedicure/manicure assist kit as described in claim 2, further comprising a lid for the container.

11. The portable pedicure/manicure assist kit as described in claim 2, wherein the support assembly is mounted to the container with a forward end of the foot/hand rest member disposed above the cavity.

12. The portable pedicure/manicure assist kit as described in claim 11, wherein the support assembly is removably mounted to the side wall of the container with a portion of the side wall disposed in the slot between the first and second support members.

13. The portable pedicure/manicure assist kit as described in claim 2, wherein the container has a slot disposed through a top edge of the side wall and downwardly in the side wall.

14. The portable pedicure/manicure assist kit as described in claim 13, wherein the support assembly is mounted to the side wall in the slot of the container with a portion of the side wall below the slot in the sidewall received between the first and second support members and engaged between the screw and the second support member.

15. The portable pedicure/manicure assist kit as described in claim 12, wherein the foot/hand rest member is slanted upwardly from the rearward end to the forward end when the support assembly is mounted to the side wall of the container.

16. The portable pedicure/manicure assist kit as described in claim 10, wherein the lid has an outer edge with clips spaced apart and extending from the outer edge, and the container has catches spaced apart and disposed along a top edge of the side wall, wherein the lid is removable from the container with the clips being detachably attached to the catches.

17. The portable pedicure/manicure assist kit as described in claim 10, further comprising a light-emitting member and a fan attached to an underside of the lid, and further comprising a lid support member pivotably attached to the underside of the lid for securing the lid in a partially opened position above the container.

18. The portable pedicure/manicure assist kit as described in claim 2, further comprising a tray removably disposed in the cavity of the container, wherein the tray includes a perimeter wall that defines a cavity of the tray.

19. The portable pedicure/manicure assist kit as described in claim 14, wherein the foot/hand rest member is slanted upwardly from its rearward end to its forward end when the support assembly is mounted to the container.

20. The portable pedicure/manicure assist kit as described in claim 2, further comprising a handle that is attached to the side wall of the container.

* * * * *